US005482147A

United States Patent [19]

Wang

[11] Patent Number: 5,482,147

[45] Date of Patent: Jan. 9, 1996

[54] RETRACTABLE LUGGAGE HANDLE MOUNTING HARDWARE

[76] Inventor: King S. Wang, No. 569, Ching-Kuo Rd., Ta-Chia Chen, Taichung Hsien, Taiwan

[21] Appl. No.: 346,237

[22] Filed: Nov. 23, 1994

Related U.S. Application Data

[62] Division of Ser. No. 247,569, May 23, 1994, abandoned.

[51] Int. Cl.[6] ..... A45C 13/00

[52] U.S. Cl. ..... 190/115; 190/18 A

[58] Field of Search ..... 190/18 A, 114, 190/115; 16/115

[56] References Cited

U.S. PATENT DOCUMENTS

| | | | |
|---|---|---|---|
| 3,842,953 | 10/1974 | Royet | 190/18 A |
| 4,284,287 | 8/1981 | Esposito . | |
| 4,314,624 | 2/1982 | Royet . | |
| 4,329,076 | 5/1982 | Coreth | 16/115 X |
| 4,354,689 | 10/1982 | Perego . | |
| 4,616,379 | 10/1986 | Lio | 16/115 |
| 4,960,015 | 10/1990 | Mathews | 16/115 X |
| 4,995,487 | 2/1991 | Plath | 190/115 X |
| 5,167,306 | 12/1992 | Carrigan, Jr. | 190/115 X |
| 5,295,565 | 3/1994 | Latshaw . | |
| 5,355,980 | 10/1994 | Hsieh . | |

*Primary Examiner*—Allan N. Shoap
*Assistant Examiner*—Christopher J. McDonald
*Attorney, Agent, or Firm*—Bacon & Thomas

[57] ABSTRACT

A retractable luggage handle mounting hardware including a top mounting frame, a sleeve holder and a bottom mounting frame respectively fastened to a luggage on the inside to hold a retractable handle, wherein the luggage has an opening on the top panel thereof aligned with the top mounting frame, and a cover flap fastened to the top panel by a zip fastener to close the opening of the top panel permitting the hand grip to be concealed inside the luggage when the retractable handle is collapsed.

2 Claims, 4 Drawing Sheets

RETRACTABLE LUGGAGE HANDLE MOUNTING HARDWARE

This application is a division of application Ser. No. 08/247,569, filed May 23, 1994, abandoned.

BACKGROUND OF THE INVENTION

The present invention relates to a retractable luggage handle mounting hardware which permits the retractable handle to be concealed inside the luggage when collapsed.

A luggage may be provided with a retractable handle so that it can be conveniently moved on the ground. FIG. 1 shows a luggage having a retractable handle. This retractable handle is functional, however it may be damaged easily between the hand grip is exposed to the outside when the retractable handle is collapsed.

SUMMARY OF THE INVENTION

The present invention has been accomplished to provide a retractable luggage handle mounting hardware which eliminates the aforesaid problem. According to one embodiment, the luggage has an opening on the top panel thereof, through which the hand grip of the retractable handle passes, and a cover flap fastened to the top panel by a zip fastener to close the opening of the top panel, and therefore the hand grip of the retractable handle can be concealed inside the luggage when the retractable handle is collapsed.

DETAILED DESCRIPTION OF THE PREFERRED EMBODIMENT

Figure 1:
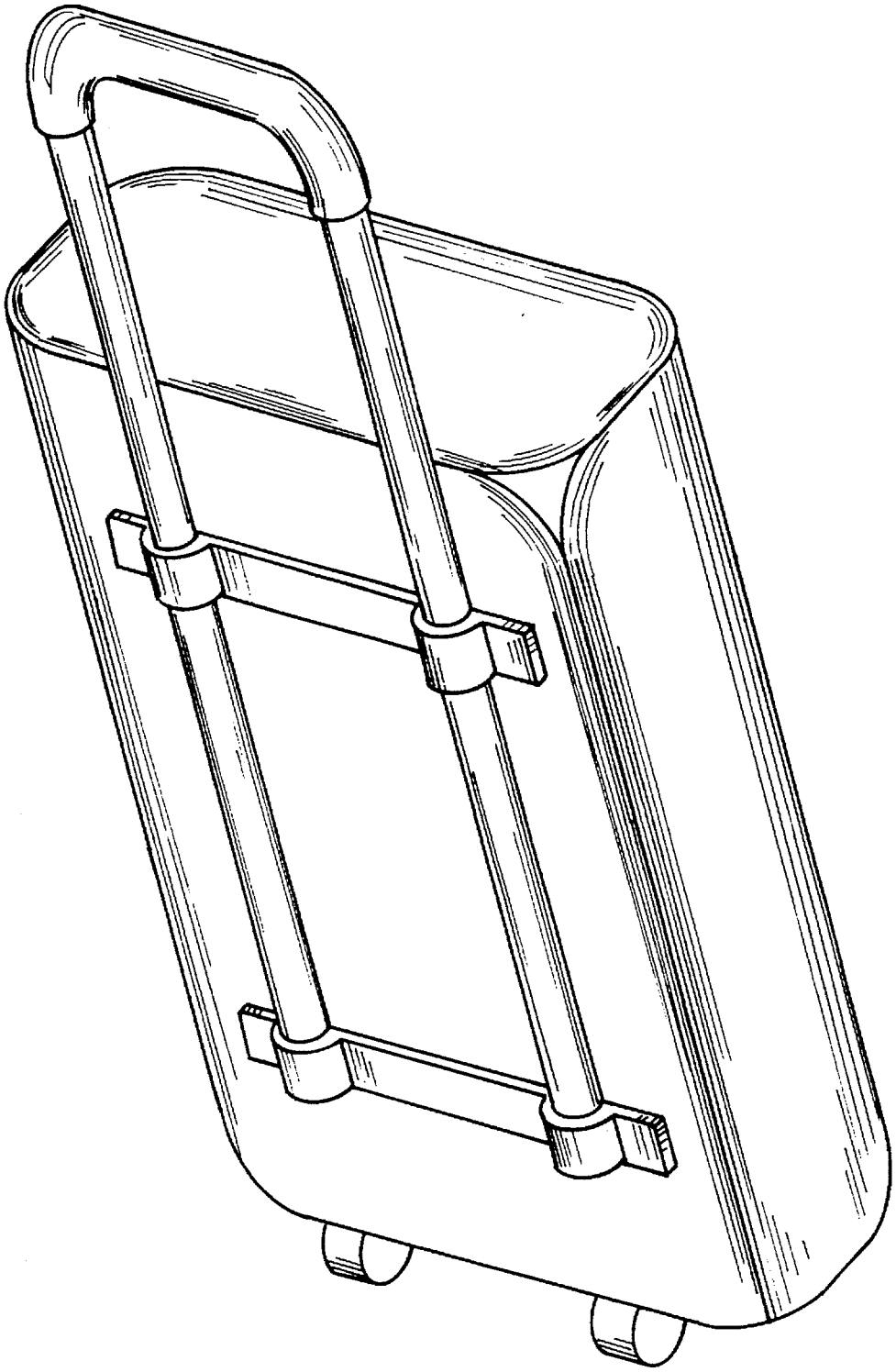
Fig. 1 PRIOR ART
FIG. 1 shows a luggage having a retractable handle according to the prior art.
Figure 2:
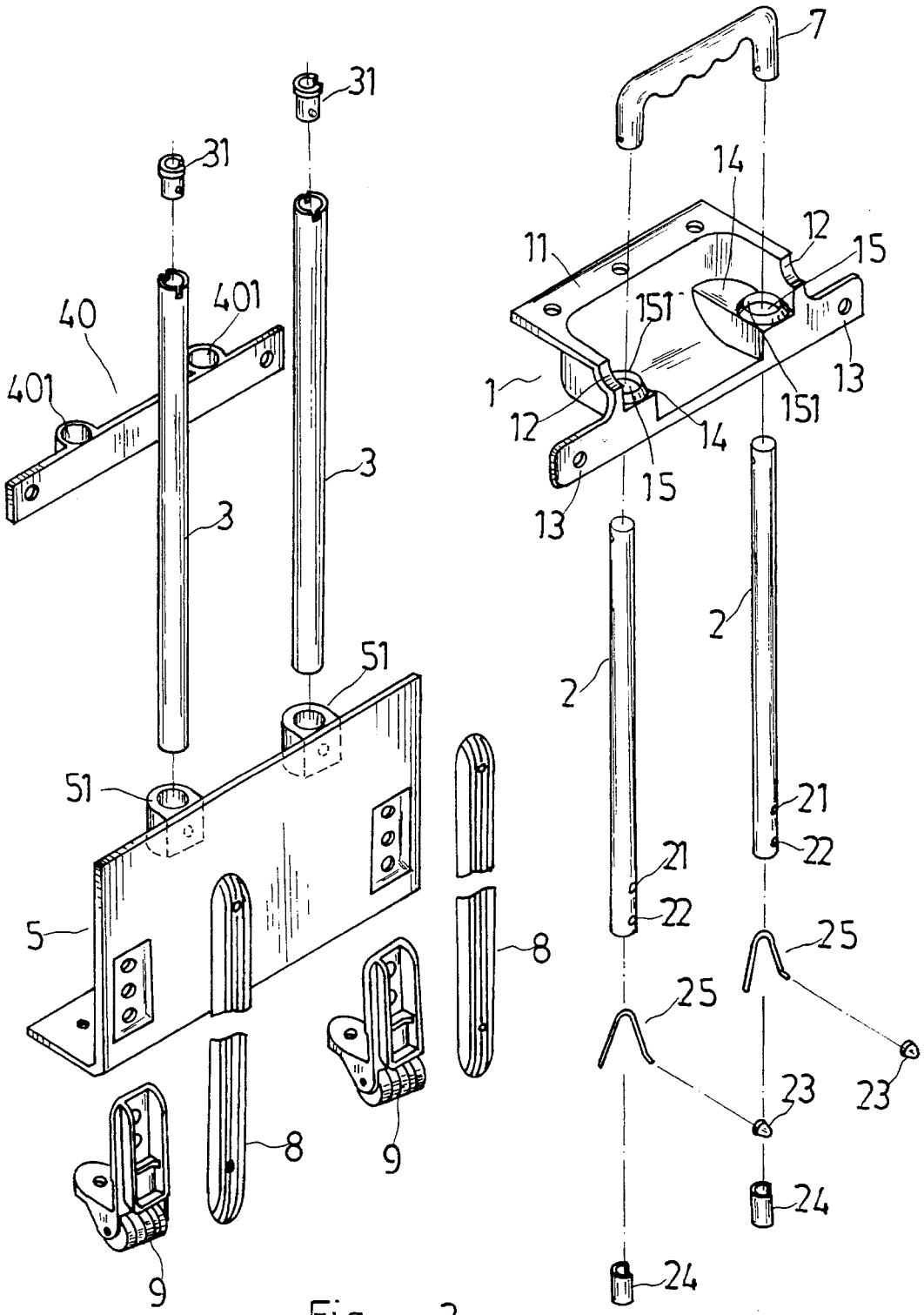
FIG. 2 is an exploded view of the of the present invention.
Figure 3:
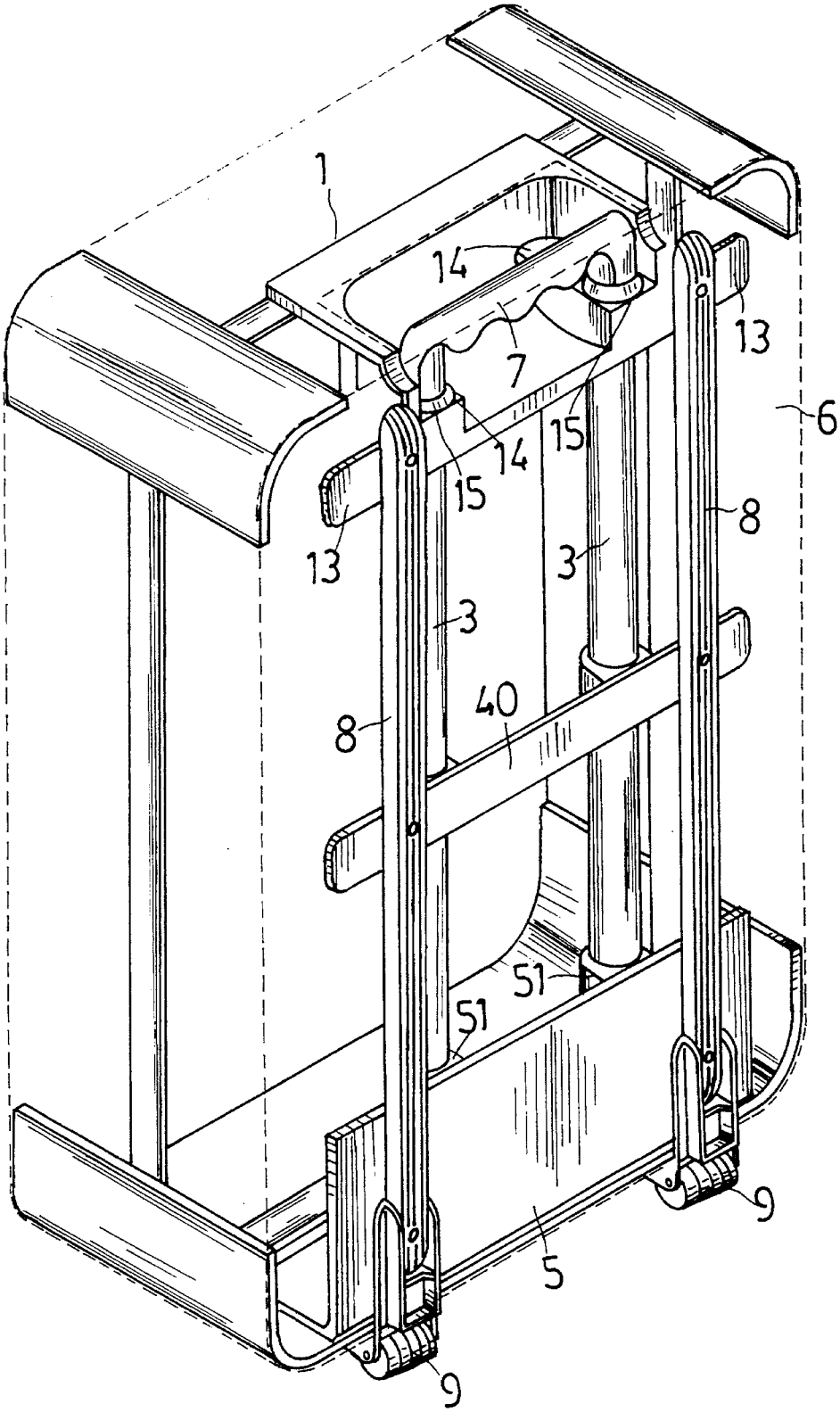
FIG. 3 is an installed view of the present invention.

Referring to FIGS. 2 and 3, the present invention comprises mainly a top mounting frame 1 fastened to the top and back panels of a luggage 6, a bottom mounting frame 5 fastened to the bottom and back panels of the luggage 6, two sleeves 3 connected between the top and bottom mounting frames 1 and 5, a sleeve holder 40 spaced between the top and bottom mounting frames 1 and 5 to hold the sleeves 3 in place, two inner tubes 2 made to slide in and out of the sleeves 3, and a handgrip 7 coupled to the inner tubes 2 at the top.

Referring to FIG. 2 again, the top mounting frame 1 is a substantially L-shaped hollow frame comprising a horizontal mounting flange 11 around the periphery thereof at the top side, two vertical mounting flanges 13 respectively extended outwards from the open back side thereof in reversed directions, two arched notches 12 bilaterally disposed between the horizontal mounting flange 11 and the vertical mounting flanges 13, two parallel platforms 14 bilaterally disposed on the inside, two axle holes 15 through the platforms 14 respectively. The axle hole 15 has a tapered orifice 151 at the top made gradually bigger toward the outside. The inner tubes 2 are respectively inserted through the axle holes 15, having each a top end coupled to either end of a hand grip 7 and a bottom end made with two vertically spaced through holes 21 and 22 and inserted into either outer tube 3. A curved spring wire 25 is mounted within the bottom end of either inner tube 2, having one end stopped against the inside wall of the respective inner tube 2 and an opposite end coupled with a tip 23 partially extended out of the upper through hole 21. A C-ring 24 is fastened to the bottom end of either inner tube 2 on the outside, having a raised portion (not shown) engaging the lower through hole 22. The sleeves 3 have each a top end fastened with a C-ring 31 on the inside. The sleeve holder 40 is an elongated frame having two barrels 401, which receive either sleeve 3. The bottom mounting frame 5 is shaped like an angle plate provided with wheel assemblies 9 at the bottom and, having two barrels 51 vertically and bilaterally disposed at the top, which received either sleeve 3.

Referring to FIG. 3, the top and bottom mounting frames 1 and 5 are respectively fixed to the top, bottom and back panels of the luggage 6 by fastening devices to hold the sleeves 3 and the inner tubes 2 inside the sleeves 3 permitting the sleeves 3 to pass through the barrels 501 on the sleeve holder 40. After the wheel assemblies 9 are respectively fixed to the bottom mounting frame 5 and disposed outside the bottom panel of the luggage 6, two packing bars 8 are mounted on the back panel of the luggage 6 and fixed to the top and bottom mounting frames 1 and 5 and the sleeve holder 40. Furthermore, the luggage 6 has an opening on the top panel thereof aligned with the top mounting frame 1 and reopenably closed by a cover flap 16. The cover flap 16 may be fastened to the top panel of the luggage 6 by a zip fastener so that it can be conveniently opened and then closed. When the retractable handle is not used, the hand grip 7 is received inside the top panel of the luggage 6 and covered by the cover flap 16. When in use, the cover flap 16 is opened, then the handgrip 7 is pulled out of the top panel of the luggage 6. When the inner tubes 2 are pulled out of the sleeves 3, the C-rings 24 of the inner tubes 2 are stopped by the C-rings 31 of the sleeves 3 and therefore, the inner tubes 2 do not disconnect from the sleeves 3. At the same time, the tips 23 respectively project out of the through holes 21 into the tapered orifice 151 and stopped outside the sleeves 3. As the diameter of the tapered orifice 151 is reducing downwards, pushing the hand grip 7 downwards causes the tips 23 moved back inside the inner tubes 2 permitting the inner tubes 2 to be moved back into inside the sleeves 3 respectively. When collapsed, the hand grip 7 is received within the top mounting frame 1 between the arched notches 12 and covered by the cover flap 16 inside the top panel of the luggage 6.

Figure 4:
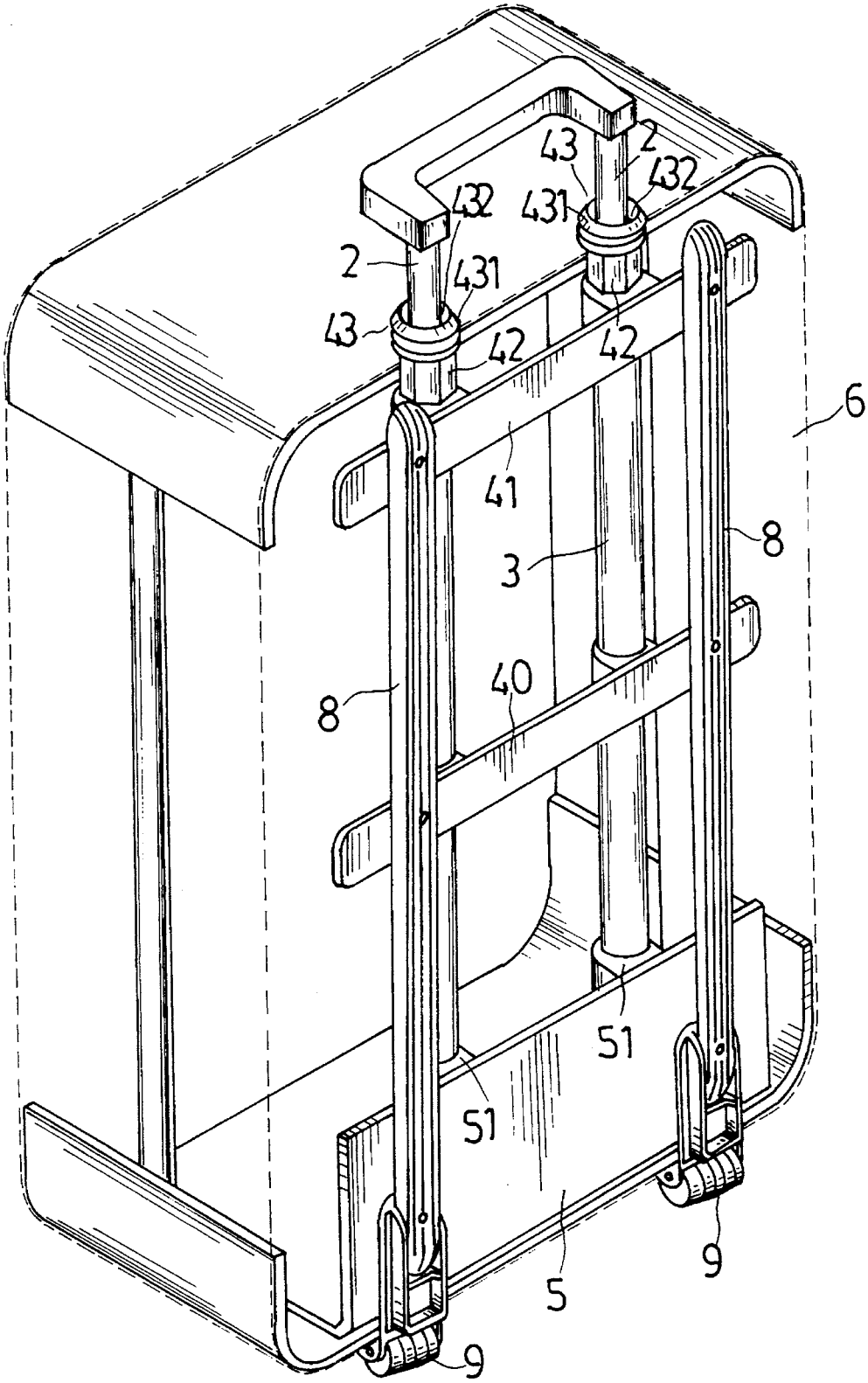
FIG. 4 shows an alternate form of the present invention.

Referring to FIG. 4, therein illustrated is an alternate form of the present invention. According to this alternate form, the aforesaid cover flap 16 and top mounting frame 1 are eliminated and, an additional sleeve holder 41 is provided and fastened to the back panel of the luggage 6 at the top to hold the top ends of the sleeves 3. When top end of either sleeve 3 is inserted through a respective barrel 411 on the sleeve holder 41, a flanged octagonal nut 42 with a screw hole (not shown) in it is mounted around the top end of either sleeve 3 and stopped above the respective barrel 411, and then a flanged hollow screw member 43 is inserted through a respective opening (not shown) on the luggage 6 and threaded into the flanged octagonal nut 42. The flanged octagonal nut 42 has an outward flange 421 at the top stopped against the top panel of the luggage 6 on the inside. The flanged hollow screw member 43 has an outward flange 431 at the top stopped above the top panel of the luggage 6 against thee outward flange 421 of the respective octagonal nut 42, and a tapered orifice 432 within the outward flange 431. The diameter of the tapered orifice 432 is made gradually bigger toward the outside so that it functions as the tapered orifice 151 on either axle hole 15 shown in FIG. 2.

I claim:

1. A retractable luggage handle mounting hardware for luggage having a top panel, a bottom panel, a front panel, a back panel, and two opposite side panels, and comprising: a top mounting frame fastened to the top and back panels: a bottom mounting frame fastened to the bottom and back panels of said luggage; a first sleeve holder transversely fastened to the back panel of said luggage at a top thereof; a second sleeve holder transversely fastened to the back panel of said luggage and spaced between said bottom mounting frame and said first sleeve holder; and a retractable handle, said retractable handle comprising; a hand grip; two sleeves each having a top end inserted through a respective barrel on said second sleeve holder and fitted into a respective barrel on said first sleeve holder; and a bottom end fitted into a respective barrel on said bottom mounting frame; two inner tubes each having a bottom end slidably inserted into a sleeve and a top end extending out of said top mounting frame and coupled to an end of said hand grip; two flanged octagonal nuts each respectively mounted on a barrel of said first sleeve holder to hold the top end of a sleeve and each having an outward top flange and a screw hole; and two flanged hollow screw members threaded into the screw hole on a flanged octagonal nut, through which the top end of an inner tube passes, said flanged hollow screw members each having an outward top flange stopped above the top panel of said luggage against the outward top flange of the corresponding octagonal nut.

2. The retractable luggage handle mounting hardware of claim 1 wherein the hollow screw members each have a tapered orifice made gradually bigger toward the outside.

* * * * *